US012264855B2

(12) United States Patent
Schneck et al.

(10) Patent No.: US 12,264,855 B2
(45) Date of Patent: Apr. 1, 2025

(54) CASCADE HEAT PUMP AND METHOD FOR HEATING OR COOLING A COOLANT BY MEANS OF A CASCADE HEAT PUMP

(71) Applicant: Volkswagen Aktiengesellschaft, Wolfsburg (DE)

(72) Inventors: Christian Schneck, Braunschweig (DE); Juergen Olfe, Volkse (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 263 days.

(21) Appl. No.: 18/077,735

(22) Filed: Dec. 8, 2022

(65) Prior Publication Data

US 2023/0184468 A1 Jun. 15, 2023

(30) Foreign Application Priority Data

Dec. 13, 2021 (DE) ..... 10 2021 214 258.3

(51) Int. Cl.
*F25B 30/00* (2006.01)
*F25B 41/40* (2021.01)

(52) U.S. Cl.
CPC ..... *F25B 30/00* (2013.01); *F25B 41/40* (2021.01); *F25B 2321/001* (2013.01); *F25B 2321/002* (2013.01)

(58) Field of Classification Search
CPC .. F25B 29/00; F25B 7/00; F25B 21/04; F25B 25/005; F25B 2321/002; F25B 2321/001; F25B 41/40; F25B 30/00
See application file for complete search history.

(56) References Cited

U.S. PATENT DOCUMENTS

| | | | | |
|---|---|---|---|---|
| 5,157,925 | A | 10/1992 | Denton et al. | |
| 5,170,639 | A | 12/1992 | Datta | |
| 9,234,676 | B2 | 1/2016 | Kim et al. | |
| 10,465,951 | B2 | 11/2019 | Benedict | |
| 2015/0107268 | A1 | 4/2015 | Han et al. | |
| 2017/0089612 | A1 | 3/2017 | Van Bael | |
| 2019/0154309 | A1 * | 5/2019 | Kniffler | F25B 9/10 |

(Continued)

FOREIGN PATENT DOCUMENTS

| | | | |
|---|---|---|---|
| CN | 202709358 | U | 1/2013 |
| CN | 109260750 | A | 1/2019 |
| CN | 112325510 | A | 2/2021 |

(Continued)

*Primary Examiner* — Ana M Vazquez
(74) *Attorney, Agent, or Firm* — Muncy, Geissler, Olds & Lowe, P.C.

(57) ABSTRACT

In order to provide a cascade heat pump with which a large temperature lift can be provided with high efficiency, a cascade heat pump comprising n stages where n≥2 is proposed. Each of the n stages has a heat pump with a coolant inlet, a first coolant outlet, and a second coolant outlet. Each heat pump has a hot side and a cold side and a flow divider to divide a coolant flow entering the coolant inlet between the hot side and the cold side. The first coolant outlet of the heat pump of each stage i, where i=1 . . . n−1, is connected to the coolant inlet of the heat pump of a subsequent stage i+1. The second coolant outlet of the heat pump of at least one subsequent stage i+1 is connected by a recirculation line to the coolant inlet of the heat pump of a preceding stage.

11 Claims, 3 Drawing Sheets

(56) References Cited

U.S. PATENT DOCUMENTS

| | | | |
|---|---|---|---|
| 2019/0257555 | A1 | 8/2019 | Rowe et al. |
| 2021/0140687 | A1 | 5/2021 | Linares |

FOREIGN PATENT DOCUMENTS

| | | | |
|---|---|---|---|
| DE | 223221 | A1 | 6/1985 |
| DE | 102018219714 | A1 | 12/2019 |
| EP | 2397782 | A2 | 12/2011 |
| EP | 2827068 | A1 | 1/2015 |
| EP | 2793561 | B1 | 2/2017 |
| EP | 3296658 | B1 | 3/2021 |

* cited by examiner

CASCADE HEAT PUMP AND METHOD FOR HEATING OR COOLING A COOLANT BY MEANS OF A CASCADE HEAT PUMP

This nonprovisional application claims priority under 35 U.S.C. § 119(a) to German Patent Application No. 10 2021 214 258.3, which was filed in Germany on Dec. 13, 2021, and which is herein incorporated by reference.

BACKGROUND OF THE INVENTION

Field of the Invention

The present invention relates to a cascade heat pump comprising n stages where n≥2. In addition, the present invention relates to a method for heating or cooling a coolant, carried out with a cascade heat pump comprising n stages where n≥2.

Description of the Background Art

Caloric heat pumps can be used in many areas of heating and cooling engineering, including in automotive manufacturing, in particular.

One of the greatest technical challenges in the development of efficient caloric heat pumps is the comparatively small temperature lift of the caloric materials, which is typically between 2 and 10 K. Temperature lift is understood here to mean the difference between the temperature of the gaseous or liquid coolant flowing into the heat pump and the temperature of the coolant flowing out. This temperature difference is limited by the temperature change of the caloric material during the phase transition and the thermodynamic conditions in the heat pump, which are influenced by the surfaces, the flow velocity, heat transfers, etc. This applies to elastocaloric heat pumps as well as to magnetocaloric and electrocaloric heat pumps.

Particularly in motor vehicles, a significantly larger temperature lift is required for cooling and heating of the passenger compartment as well as for thermal management of the battery and electronics than can be achieved with the materials available today for caloric heat pumps.

Known from CN 112 325 510 A is a cascade heat pump composed of multiple heat pumps that is suitable for use in a large power plant. The heat pumps are connected in parallel to form a multistage cascade heat pump.

DE 10 2018 219 714 A1 discloses a heat transfer device for a fluid exchange device for temperature control of a fluid flowing through the fluid exchange device, having at least one inlet channel for guiding the fluid, having at least one outlet channel, in particular for recirculation of the fluid, and having at least one heat conducting unit arranged between the inlet channel and the outlet channel for exchanging heat between the inlet channel and the outlet channel, wherein at least one membrane element capable of oscillation that is arranged within the heat conducting unit is provided for conducting heat in an oscillation position-dependent manner between the membrane element and the inlet channel and/or the outlet channel.

Known from CN 109 260 750 A is a device that essentially has an evaporative drying device, a primary heat pump-coupled air heating system, a secondary heat pump-coupled air heating system, a tertiary heat pump-coupled air heating system, and a quaternary heat pump-coupled air heating system, which have the same construction type and the same connection form.

EP 3 296 658 B1 discloses an exhaust air heat pump comprising an inlet channel for indoor exhaust air, an outlet channel for exhaust air, and a heat pump unit for heat recovery from the exhaust air or indoor air.

DD 223 221 A1 discloses an absorption heat pump for generating heating energy, with which the different supply temperatures required due to seasonal factors are achieved at an optimal thermal ratio with continuous use of environmental energy. In accordance with one circuit, a single-stage system is integrated into a two-stage absorption heat pump through valve combinations and bypass lines. In the case of a two-stage circuit arrangement, the water circuit for heating is accomplished through the high-temperature absorber and the condenser, while an additional circuit is provided through the low-temperature absorber for domestic water heating. In single-stage operation, in contrast, all the water flow is routed through the low-temperature absorber and the condenser and is divided for domestic water heating and heat.

US 2019/0257555 A1 discloses a magnetocaloric heat pump with a regenerator assembly and a rotatable field generator.

Known from U.S. Pat. No. 10,465,951 B2 is a heat pump system that uses variable magnetization to control the amount of magnetocaloric material subjected to the magnetic field.

Known from US 2017/0089612 A1 is a multistage heat pump that has an evaporator, a condenser, and expansion stages, vapor compression stages, and tanks for holding the gaseous phases of a fluid.

SUMMARY OF THE INVENTION

It is therefore an object of the present invention to provide a cascade heat pump with which a large temperature lift can be provided with high efficiency. It is a further object of the present invention to provide a method for heating or cooling a coolant.

In an exemplary embodiment, a cascade heat pump is provided having n stages where n≥2, wherein each of the n stages has a heat pump with a coolant inlet, with a first coolant outlet, and with a second coolant outlet, wherein each heat pump has a hot side and a cold side and a flow divider, wherein the flow divider is equipped to divide a coolant flow entering the coolant inlet between the hot side and the cold side, wherein the first coolant outlet of the heat pump of each stage i, where i=1 . . . n−1, is connected to the coolant inlet of the heat pump of a subsequent stage i+1, wherein provision is further made that the second coolant outlet of the heat pump of at least one subsequent stage i+1, where i=1 . . . n−1, is connected with by means of a recirculation line to the coolant inlet of the heat pump of a preceding stage 1 . . . i.

The cascade heat pump is designed to heat or cool a coolant. The coolant can be a liquid coolant or a gaseous coolant such as, e.g., water or air.

With the cascade heat pump according to the invention, a multiplication of the temperature lift of the coolant can be achieved through the concatenation of multiple stages or multiple heat pumps.

In this case, the maximum achievable temperature lift of the heat pump is generated in each of the stages, or in each of the heat pumps of the respective stages. In each of the stages, a coolant entering the respective coolant inlet is divided by a flow divider into a partial flow for the hot side and a partial flow for the cold side in the associated heat pump. In operation of the heat pumps, heat is then transferred from the partial flow of the coolant on the cold side into the partial flow of the coolant on the hot side. Depending on whether the cascade heat pump is designed to heat or to cool a consumer system, either the partial flow of the hot side or the partial flow of the cold side is conducted out of the first coolant outlet of the respective heat pump of each stage and fed to the coolant inlet of the heat pump of the subsequent stage. Accordingly, the partial flow of the remaining cold side or hot side then passes out of the respective second coolant outlet of the heat pump of each stage.

If, for example, the coolant from the cold side passes out of the respective first coolant outlet, then the successively cooled coolant flows from one heat pump to the next heat pump. The finally cooled coolant then passes out of the first coolant outlet of the heat pump of the last stage to cool a consumer system.

According to the invention, for at least one of the stages, provision is made that the coolant passing out of the second coolant outlet is fed to the coolant inlet of one of the heat pumps of a preceding stage by means of a recirculation line. In the case of the above-described cascade heat pump, this means that, in at least one of the stages, the partial flow of the hot side from the second coolant outlet of the heat pump is fed to the coolant inlet of one of the heat pumps of a preceding stage. This recirculation of a partial flow of the coolant has the advantage that the usable cooled flow volume is increased.

Without a recirculation of the flow volume, the coolant flow passing out of the first coolant outlet of the heat pump of the last stage that is usable for cooling a consumer system would, in the case of a division of the coolant into equal partial flows in each of the heat pumps, be smaller by the factor $\frac{1}{2}^n$ in the case of n stages than the coolant flow entering the coolant inlet of the heat pump of the first stage. In the case of an n-stage cascade heat pump in which a recirculation of the coolant to the immediately preceding stage takes place in each stage from the third stage onward, in contrast, the usable coolant flow passing out of the first coolant outlet of the heat pump of the last stage is smaller only by the factor $\frac{1}{2}n$ than the coolant flow entering the coolant inlet of the heat pump of the first stage. As a result of the recirculation of the coolant through at least one second coolant outlet of a heat pump of at least one stage to a preceding stage, the usable flow volume is increased and the efficiency is raised.

It is a matter of course that the roles of hot side and cold side can also be reversed in the cascade heat pump described above. In that case, the coolant from the hot side passes out of the respective first coolant outlet. The successively heated coolant flows from one heat pump to the next heat pump. The finally heated coolant then passes out of the first coolant outlet of the heat pump of the last stage to heat a consumer system. In at least one of the stages, furthermore, the partial flow of the cold side then passes out of the second coolant outlet of the heat pump and is fed to the coolant inlet of the heat pump of a preceding stage. This recirculation of a partial flow of the coolant has the advantage that the usable heated flow volume is increased.

Provision is preferably made that the second coolant outlet of the heat pump of each subsequent stage i+1, where i=2 . . . n−1, is connected by means of a recirculation line to the coolant inlet of the heat pump of a preceding stage 1 . . . i.

As a result of the fact that a recirculation of a partial flow of the coolant occurs in every stage from the third stage onward, the flow volume of the coolant that can be used for cooling or heating that is available at the first coolant outlet of the heat pump of the last stage is increased further.

Especially preferably, provision is made that the second coolant outlet of the heat pump of each subsequent stage i+1, where i=2 . . . n−1, is connected by means of a recirculation line to the coolant inlet of the heat pump of the preceding stage i.

Consequently, from the third stage onward, the partial flow of the coolant passing out of the second coolant outlet is fed back to the coolant inlet of the immediately preceding stage.

This has the advantage that, at least in the case of an equal division of the coolant between the hot side and the cold side in every heat pump, the partial flow of the coolant returned to the preceding stage i from the subsequent stage i+1 through the respective recirculation line has the same temperature level as the coolant fed to the preceding stage i from the previous preceding stage i−1.

If, for example, the achievable temperature spread in every heat pump is 10° C., then the principle can be described as follows: In the first stage, a coolant with a temperature of 20° C. enters the first coolant inlet of the heat pump, for example. Within the heat pump of the first stage, the coolant is cooled to 15° C. on the cold side and is heated to 25° C. on the hot side. The coolant therefore passes out of the first coolant outlet of the heat pump of the first stage with a temperature of 15° C., and consequently enters the coolant inlet of the second stage at 15° C. In the heat pump of the second stage, the coolant is once again cooled by 5° C. on the cold side and passes out of the first coolant outlet of the heat pump of the second stage with a temperature of 10° C. and enters the coolant inlet of the heat pump of the third stage at this temperature. The heated coolant from the second coolant outlet of the second stage has a temperature of 20° C., and the coolant passing out of the second coolant outlet of the third stage has a temperature of 15° C. The coolant passing out of the second coolant outlet of the heat pump of the third stage is fed by means of the recirculation line to the coolant inlet of the second stage, which, as explained above, has a temperature of 15° C.

It is fundamentally also possible, however, to feed the coolant flows passing out of the second coolant outlets to the previous preceding stage i−1 or to the prior previous preceding stage i−2 or to any desired preceding stage 1 . . . i.

Furthermore, provision can be made that the flow dividers of the heat pumps divide the entering coolant flow in a 50:50 ratio. Furthermore, the flow dividers can be designed to divide the coolant between the cold side and the hot side in a ratio from 20:80 to 80:20, preferably 40:60 to 60:40.

Provision is preferably made that the temperature of the coolant passing out of the second coolant outlet of the heat pump of the respective stage and returned to the preceding stage corresponds to the temperature of the coolant fed to the coolant inlet of the heat pump of the preceding stage from the stage preceding that one in turn.

The heat pumps can be caloric heat pumps, in particular electrocaloric heat pumps, magnetocaloric heat pumps, or elastocaloric heat pumps.

To further advantage, provision is made that each heat pump is equipped to achieve a temperature spread of the coolant between the hot side and the cold side of at least 5° C., preferably of at least 10°, further preferably of at least 20° C.

Preferably, provision can be made that at least the first coolant outlet of the heat pump of the last stage i=n is connected to a first coolant branch, wherein the first coolant branch is connected to the coolant inlet of the heat pump of the first stage i=1.

Further, the first coolant branch can include a heat exchanger.

When the respective cold sides are associated with the first coolant outlet of the heat pumps of the respective stages, then a cooled coolant passes out of the first coolant outlet of the heat pump of the last stage. This coolant is conducted into the first coolant branch and can be fed again to the coolant inlet of the heat pump of the first stage through the first coolant branch in order to create a closed coolant circuit.

A heat exchanger, for example a heat exchanger for a vehicle passenger compartment, can be located in the first coolant branch. Heat can be absorbed from the vehicle passenger compartment by means of the heat exchanger in order to cool the passenger compartment. The cooled coolant can be heated again to a temperature of, for example, 20° C. by the heat absorbed through the heat exchanger, and is again fed to the coolant inlet of the first heat pump at this higher temperature.

At least the second coolant outlet of the heat pump of the first stage i=1 can be connected to a second coolant branch, wherein the second coolant branch is connected to the coolant inlet of the heat pump of the first stage i=1.

The second coolant outlet of the heat pumps of each of the first i stages, i=1 . . . n−1, preferably of the first two stages, can be connected to the second coolant branch.

The coolant that can pass out of each second coolant outlet of the heat pumps of the first and second stages is fed to a second coolant branch. In this case, a cooler can be located in the second coolant branch. The cooler can, for example, be a cooler for dissipating the heat of the coolant flow in the second coolant branch to the outside environment. Alternatively, the cooler can also be a heat exchanger for a traction battery of a battery electric vehicle or hybrid electric vehicle so that the battery can be temperature-controlled by means of the heat exchanger. Heat is therefore transferred from the heated coolant in the second coolant branch to the battery or to the outside environment, so that the temperature of the coolant in the second coolant branch decreases. Subsequently, the coolant flow is again fed to the coolant inlet of the heat pump of the first stage, where it mixes with the coolant fed from the first coolant branch.

In the case of air as coolant, it is also possible to dispense with the first coolant branch and the second coolant branch as well as the first heat exchanger and the second heat exchanger or the cooler. In this case, the cooled air from the first coolant outlet of the heat pump of the last stage i=n can be used directly for cooling of, e.g., the vehicle passenger compartment, and the heated air from the second coolant outlets of the heat pumps of the first i stages, i=1 . . . n−1, preferably of the first two stages, is blown into the outside air. In the case of a reversal, explained below, of the association of hot side and cold side to the first coolant outlet and the second coolant outlet of the heat pumps of each stage, the heated air from the first coolant outlet of the heat pump of the last stage i=n can be used directly for heating of, e.g., the vehicle passenger compartment.

The association of hot side and cold side to the first coolant outlet and the second coolant outlet of the heat pumps of each stage can therefore also be reversed in the explanations above.

In that case, a heated coolant flow passes out of the first coolant outlet of the heat pump of the last stage, and is fed to the first coolant branch. A heating of the vehicle passenger compartment can be taken care of by means of the heat exchanger arranged in the first coolant branch. The coolant that is cooled as a result is again fed to the coolant inlet of the heat pump of the first stage through the first coolant branch. At the same time, the cooled coolant passing out of the second coolant outlet of the heat pumps of the stages without coolant recirculation is conducted into the second coolant branch, which can have a further heat exchanger. By means of the heat exchanger, the cooled coolant in the second coolant branch can be heated up again through the absorption of thermal energy, for example from the vehicle environment. Alternatively, the cooled coolant in the second coolant branch can be used for cooling of vehicle components such as, e.g., the battery, or for the drive motors. The coolant thus reheated in the second coolant branch is likewise fed to the coolant inlet of the heat pump of the first stage and mixed with the cooled coolant from the first coolant branch.

The first coolant outlet of every heat pump can be associated with the hot side and that the second coolant outlet of every heat pump can be associated with the cold side, or that the first coolant outlet of every heat pump is associated with the cold side and that the second coolant outlet of every heat pump is associated with the hot side.

Preferably, provision is further made that each heat pump can have a switchover device, wherein the switchover device is designed to selectably associate the hot side with the first coolant outlet and the cold side with the second coolant outlet or associate the cold side with the first coolant outlet and the hot side with the second coolant outlet.

By means of the switchover device, the cascade heat pump can be used selectably for heating or cooling of the coolant flow. The switchover device can be implemented in this case by valves, suitable transmissions, or switching mechanisms.

The switchover device serves, in particular, to exchange the hot sides and the cold sides of the heat pumps with one another with regard to the first coolant outlet and the second coolant outlet of the respective heat pumps.

To advantage, provision can be made that at least five, preferably at least seven, further preferably at least ten, stages are provided.

Another solution to the object of the invention is in the provision of a method for heating or cooling a coolant, carried out with an above-described cascade heat pump comprising n stages where n≥2, wherein a coolant flow is fed to a coolant inlet of the heat pump of the first stage i=1, wherein, in each of the stages i where i=1 . . . n−1, a first partial flow of the coolant is fed to the coolant inlet of the heat pump of the subsequent stage i+1 through the first coolant outlet of the respective heat pump, wherein provision is further made that, in at least one of the subsequent stages i+1 where i=1 . . . n−1, a second partial flow of the coolant is fed to the coolant inlet of the heat pump of a preceding stage 1 . . . i through the second coolant outlet of the respective heat pump.

All features, functions, and characteristics explained above in connection with the cascade heat pump can also be applied in analogous or corresponding manner to the method for heating and cooling a coolant.

Accordingly, provision is preferably made that, in each of the subsequent stages i+1, where i=2 . . . n−1, the second partial flow of the coolant is fed to the coolant inlet of the heat pump of a preceding stage 1 . . . i through the second coolant outlet of the respective heat pump.

Provision is preferably made that, in each of the subsequent stages i+1, where i=2 . . . n−1, the second partial flow of the coolant is fed to the coolant inlet of the heat pump of the preceding stage i through the second coolant outlet of the respective heat pump.

It is further preferred that the heat pumps of each stage i are caloric heat pumps, in particular electrocaloric heat pumps, magnetocaloric heat pumps, or elastocaloric heat pumps.

Furthermore, provision can be made that each heat pump can achieve a temperature spread of the coolant between the hot side and the cold side of at least 5° C., preferably of at least 10°, further preferably of at least 20° C.

To further advantage, provision can be made that, at least in the last stage i=n, the first partial flow of the coolant is fed to a first coolant branch through the first coolant outlet of the heat pump, wherein the first coolant branch feeds the partial flow of the coolant to the coolant inlet of the heat pump of the first stage i=1.

In addition, provision can be made that, at least in the first stage i=1, preferably in the first two stages, the second partial flow of the coolant is fed to a second coolant branch through the respective second coolant outlet of the respective heat pump, wherein the second coolant branch feeds the partial flow of the coolant to the coolant inlet of the heat pump of the first stage i=1.

Provision is preferably made that, in each stage i, the first coolant outlet of every heat pump is associated with the hot side and that the second coolant outlet of every heat pump is associated with the cold side, or that the first coolant outlet of every heat pump is associated with the cold side and that the second coolant outlet of every heat pump is associated with the hot side.

Furthermore, provision can be made that a switchover device is provided in each stage i, wherein the switchover device selectably associates the hot side with the first coolant outlet and the cold side with the second coolant outlet or associates the cold side with the first coolant outlet and the hot side with the second coolant outlet.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
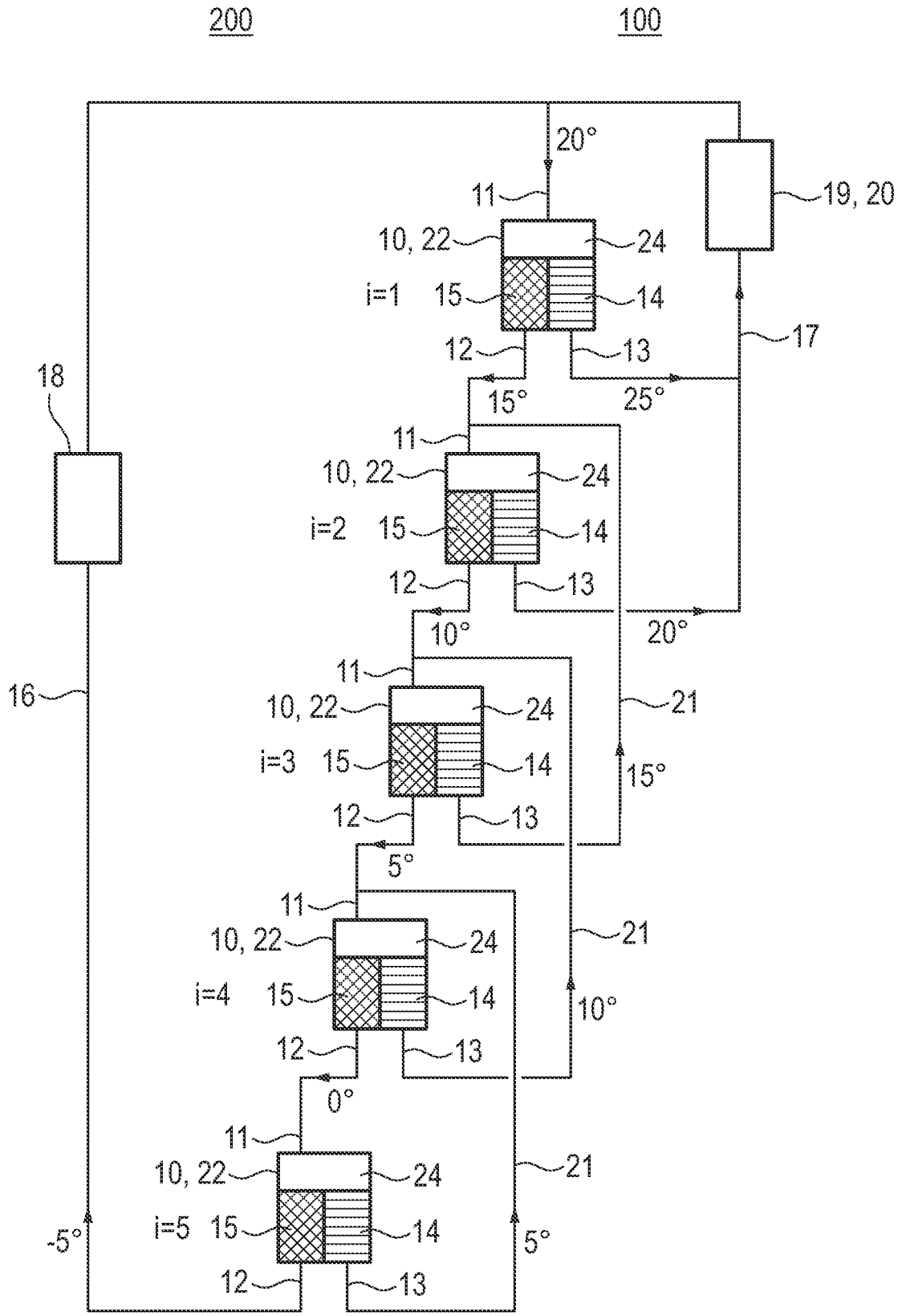
FIG. 1 shows an example of a cascade heat pump.

FIG. 1 shows a cascade heat pump 100 in accordance with the invention, on the basis of which a method 200 for heating or cooling a coolant shall be explained in detail. The cascade heat pump 100 comprises five stages i=1 . . . 5. Each of the stages i includes a heat pump 10 with a coolant inlet 11, a first coolant outlet 12, and a second coolant outlet 13. Each heat pump 10 of each stage i further includes a hot side 14 and a cold side 15. In the cascade heat pump 100 shown in FIG. 1, in each stage i the cold side 15 is associated with the first coolant outlet 12 and the hot side 14 with the second coolant outlet 13. The heat pumps 10 additionally have flow dividers 24, wherein the flow dividers 24 are equipped to divide a coolant flow entering the coolant inlet 11 of the respective heat pump 10 between the hot side 14 and the cold side 15. The first coolant outlet 12 of each heat pump 10 of the first four stages i=1 . . . 4 is connected to the coolant inlet 11 of the heat pump 10 of a subsequent stage i+1. The first coolant outlet 12 of the heat pump 10 of the last stage i=5 is connected to a first coolant branch 16. Furthermore, the second coolant outlets 13 of the heat pump 10 of the first stage i=1 and of the heat pump 10 of the second stage i=2 are connected to a second coolant branch 17.

Located in the first coolant branch 16 is a heat exchanger 18 for a passenger compartment of a motor vehicle that is not shown, and another heat exchanger 19 in the form of a cooler 20 of the motor vehicle (not shown in detail) is located in the second coolant branch 17. The second coolant outlets 13 of the third through fifth stages i+1=3 . . . 5 are each connected to the coolant inlet 11 of the preceding stage i by a respective recirculation line 21, so that a coolant passing out of the second coolant outlet 13 of the heat pump 10 of the third stage i=3 is fed to the coolant inlet 11 of the heat pump 10 of the second stage i=2, a coolant passing out of the second coolant outlet 13 of the heat pump 10 of the fourth stage i=4 is fed to the coolant inlet 11 of the heat pump 10 of the third stage i=3, and a coolant passing out of the second coolant outlet 13 of the heat pump 10 of the fifth stage i=5 is fed to the coolant inlet 11 of the heat pump 10 of the fourth stage i=4.

The heat pumps 10 are designed as elastocaloric heat pumps 22. Each of the heat pumps 10 is equipped to achieve a temperature spread of the coolant between the hot side 14 and the cold side 15 of 10° C. For the purpose of explanation, it is further assumed by way of example that the coolant conducted into the coolant inlet 11 of the heat pump 10 of the first stage i=1 has a temperature of 20° C. In the heat pump 10 of the first stage i=1, the coolant is divided into two partial flows to the hot side 14 and the cold side 15, and heat is transferred from the cold side 15 to the hot side 14. The coolant passing out of the first coolant outlet 12 of the heat pump 10 of the first stage i=1 then has a temperature of 15° C. and is fed to the coolant inlet 11 of the heat pump 10 of the second stage i=2. The coolant passing out of the second coolant outlet 13 of the heat pump 10 of the first stage i=1 has a temperature of 25° C. and is fed to the second coolant branch 17. The coolant passing out of the first coolant outlet 12 of the heat pump 10 of the second stage i=2 has a temperature of 10° C. and is fed to the coolant inlet 11 of the heat pump 10 of the third stage i=3. The coolant passing out of the second coolant outlet 13 of the heat pump 10 of the second stage i=2 has a temperature of 20° C. and is likewise fed to the second coolant branch 17. The coolant passing out of the first coolant outlet 12 of the heat pump 10 of the third stage i=3 has a temperature of 5° C., and the coolant passing out of the second coolant outlet 13 of the heat pump 10 of the third stage i=3 has a temperature of 15° C. The temperature relationships of the fourth and fifth stages i=4 and i=5 apply correspondingly.

The coolant passing out of the second coolant outlet 13 of the heat pump 10 of the third stage i=3 with a temperature of 15° C. is fed to the coolant inlet 11 of the heat pump 10 of the second stage through the corresponding recirculation line 21, where it mixes with the coolant having the same temperature of 15° C. passing out of the first coolant outlet 12 of the heat pump 10 of the first stage i=1. The same applies for the coolant passing out of the second coolant outlets 13 of the heat pumps 10 of the fourth and fifth stages i=4 and i=5.

As a result of this recirculation of the coolant, the flow volume of the coolant that passes out of the first coolant outlet 12 of the heat pump 10 of the last stage i=5 that can be used for cooling decreases only by a factor $\frac{1}{2}n=\frac{1}{10}$ as compared with a reduction by the factor $\frac{1}{2}^n=\frac{1}{32}$ that would exist if no coolant recirculation were provided. A larger quantity of coolant is thus available for cooling.

The cooled coolant passing out of the first coolant outlet 12 of the heat pump 10 of the last stage i=5 is fed to the heat exchanger 18 through the first coolant branch 16, and can be used to cool the passenger compartment of the motor vehicle. In this process, the coolant located in the first coolant branch 16 absorbs the heat from the passenger compartment and is heated up again to a temperature of, for example, 20° C. The coolant passing out of the second coolant outlets 13 of the heat pumps 10 of the first and second stages i=1 and i=2 is fed to the heat exchanger 19 or the cooler 20 through the second coolant branch 17 and dissipates the heat to the outside environment through the same. Alternatively, the heat of the coolant in the second coolant branch 17 can also be used for heating a battery or other systems of the motor vehicle. As a result of the fact that the coolant in the second coolant branch 17 dissipates the heat again through the heat exchanger 19, this coolant is again cooled to, for example, 20° C., and is likewise fed to the coolant inlet 11 of the heat pump 10 of the first stage i=1 at this temperature. Here, it mixes with the heated coolant from the first coolant branch 16, and the coolant circuit is closed.

In the case of air as coolant, it is also possible to dispense with the first coolant branch 16 and the second coolant branch 17 as well as the first heat exchanger 18 and the second heat exchanger 19 or the cooler 20. In this case, the cooled air from the first coolant outlet 12 of the heat pump 10 of the last stage i=5 can be used directly for cooling of, e.g., the vehicle passenger compartment, and the heated air from the second coolant outlets 13 of the heat pumps 10 of the first and second stages i=1 and i=2 is blown into the outside air.

Figure 2:
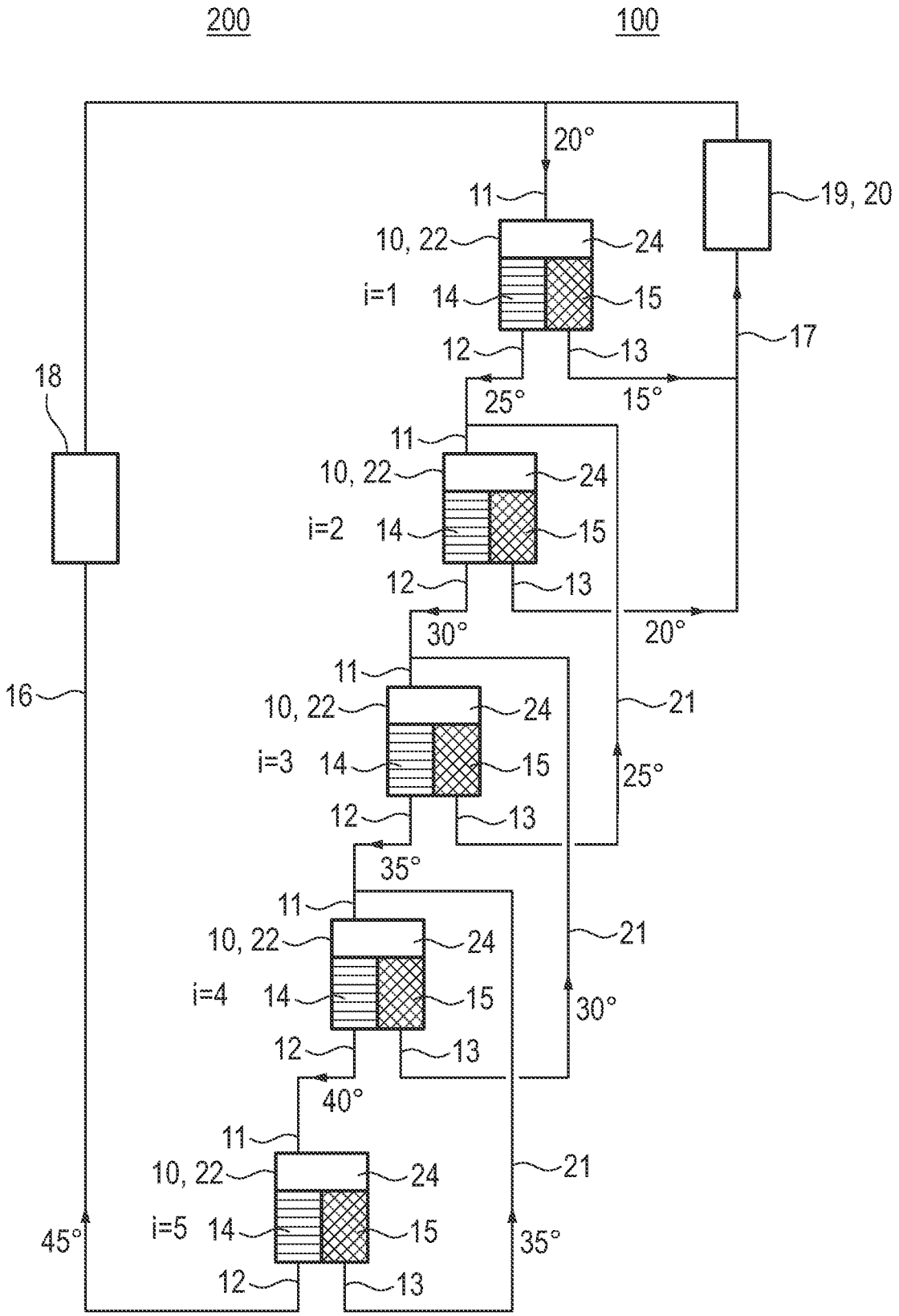
FIG. 2 shows an example of a cascade heat pump.

FIG. 2 shows an alternative embodiment of the cascade heat pump 100, which can be used to heat a passenger compartment of a motor vehicle. As compared with the cascade heat pump 100 from FIG. 1, the roles of hot side 14 and cold side 15 are reversed in each of the heat pumps 10 in the cascade heat pump 100 of FIG. 2. Consequently, the hot side 14 is associated with the first coolant outlet 12, and the cold side 15 with the second coolant outlet 13, in every heat pump 10. The coolant flows through the cascade heat pump 100 in the previously described manner, although in this case a heated coolant with a temperature of 45° C. passes out of the first coolant outlet 12 of the heat pump of the last stage i=5. In contrast, the temperatures of the coolant passing out of the second coolant outlets 13 of the heat pumps 10 of the first and second stages i=1 and i=2 are 15° C. and 20° C., respectively. The heated coolant passing out of the first coolant outlet 12 of the heat pump 10 of the last stage i=5 is used to heat the passenger compartment through the heat exchanger 18 of the first coolant branch 16. As a result, the coolant cools down, and is again fed to the coolant inlet 11 of the heat pump 10 of the first stage i=1 through the first coolant branch 16. The cooled coolant passing out of the second coolant outlets 13 of the heat pumps 10 of the first and second stages i=1 and i=2 is fed to the heat exchanger 19 through the second coolant branch 17 and is heated up again to, e.g., 20° C. through the absorption of heat. The reheated coolant in the second coolant branch 17 is mixed with the cooled coolant from the first coolant branch 16, and is fed again to the coolant inlet 11 of the heat pump 10 of the first stage i=1.

As was already true with the embodiment from FIG. 1, in the case of air as coolant it is possible to dispense with the first coolant branch 16 and the second coolant branch 17 as well as the first heat exchanger 18 and the second heat exchanger 19. In this case, the heated air from the first coolant outlet 12 of the heat pump 10 of the last stage i=5 can be used directly for heating of, e.g., the vehicle passenger compartment, and the cooled air from the second coolant outlets 13 of the heat pumps 10 of the first and second stages i=1 and i=2 is blown into the outside air.

Figure 3:
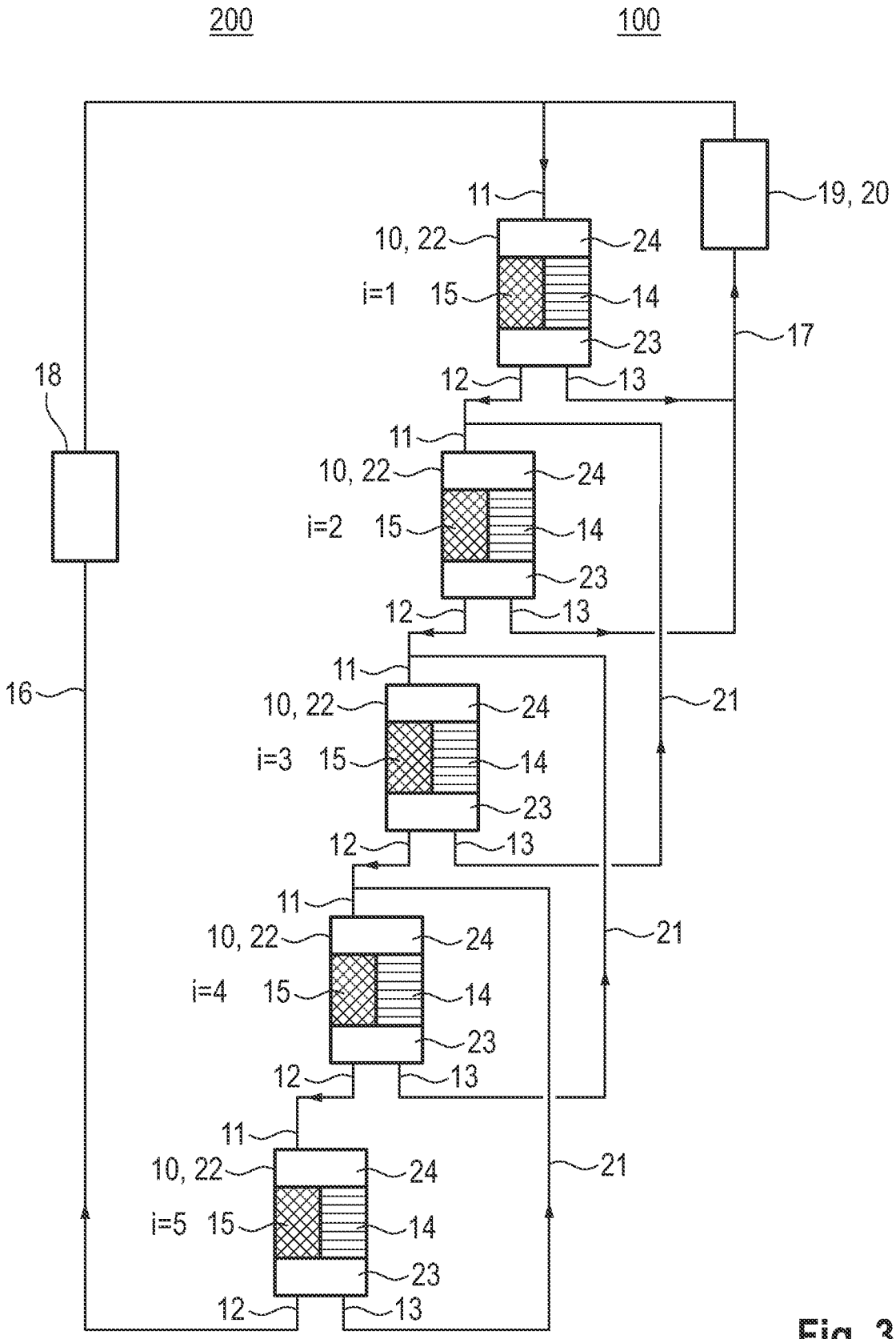
FIG. 3 shows an example of a cascade heat pump.

FIG. 3 shows another embodiment of the cascade heat pump 100. The function of the cascade heat pump 100 according to FIG. 3 corresponds to that of the cascade heat pumps 100 from FIG. 1 and FIG. 2. In this design, a switchover device 23 is provided in each of the five stages i=1 . . . 5 that is designed to selectably associate the hot side 14 with the first coolant outlet 12 and the cold side 15 with the second coolant outlet 13 or associate the hot side 14 with the second coolant outlet 13 and the cold side 15 with the first coolant outlet 12 in every heat pump 10. By simultaneous switching of the switchover devices 23, the cascade heat pump 100 from FIG. 3 can therefore be changed between the embodiments of FIGS. 1 and 2 and be used both for heating and for cooling of a motor vehicle passenger compartment.

In FIGS. 1 to 3, the cascade heat pumps 100 comprise five stages i=1 . . . 5. It is of course also possible, however, to expand the cascade heat pump 100 to seven, ten, or more stages.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A cascade heat pump comprising n stages where n≥2, each of the n stages comprising:

a heat pump with a coolant inlet, a first coolant outlet and a second coolant outlet, wherein the heat pump has a hot side and a cold side and a flow divider, wherein the flow divider divides a coolant flow entering the coolant inlet into partial flows between the hot side and the cold side, wherein the first coolant outlet of the heat pump of each stage i, where i=1 . . . n−1, is connected to the coolant inlet of the heat pump of a subsequent stage i+1, such that a first partial flow of the coolant is provided from the first coolant outlet of the heat pump of each stage i, where i=1 . . . n−1, to the coolant inlet of the heat pump of the subsequent stage i+1, and wherein the second coolant outlet of the heat pump of at least one subsequent stage i+1, where i=1 . . . n−1, is connected via a recirculation line to the coolant inlet of the heat pump of a preceding stage 1 . . . i, such that a second partial flow of the coolant is fed from the second coolant outlet of the heat pump of the at least one subsequent stage i+1, where i=1 . . . n−1, to the coolant inlet of the heat pump of the preceding stage 1 . . . i.

2. The cascade heat pump according to claim 1, wherein the second coolant outlet of the heat pump of each subsequent stage i+1, where i=2 . . . n−1, is connected via a recirculation line to the coolant inlet of the heat pump of a preceding stage 1 . . . i.

3. The cascade heat pump according to claim 2, wherein the second coolant outlet of the heat pump of each subsequent stage i+1, where i=2 . . . n−1, is connected via a recirculation line to the coolant inlet of the heat pump of the preceding stage i.

4. The cascade heat pump according to claim 1, wherein the heat pump is a caloric heat pump, an electrocaloric heat pump, a magnetocaloric heat pump, or elastocaloric heat pump, and/or wherein the heat pump is equipped to achieve a temperature spread of the coolant between the hot side and the cold side of at least 5° C., or of at least 10° C., or of at least 20° C.

5. The cascade heat pump according to claim 1, wherein at least the first coolant outlet of the heat pump of the last stage i=n is connected to a first coolant branch, wherein the first coolant branch is connected to the coolant inlet of the heat pump of the first stage i=1, and wherein the first coolant branch includes a heat exchanger.

6. The cascade heat pump according to claim 5, wherein at least the second coolant outlet of the heat pump of the first stage i=1 is connected to a second coolant branch, wherein the second coolant branch is connected to the coolant inlet of the heat pump of the first stage i=1, wherein the second coolant outlet of each of the heat pumps of the first i stages, i=1 . . . n−1, or of the first two stages, is connected to the second coolant branch, and wherein the second coolant branch includes a heat exchanger or a cooler.

7. The cascade heat pump according to claim 1, wherein the first coolant outlet of every heat pump is associated with the hot side, and wherein the second coolant outlet of every heat pump is associated with the cold side, or wherein the first coolant outlet of every heat pump is associated with the cold side, and wherein the second coolant outlet of every heat pump is associated with the hot side, and/or wherein each heat pump has a switchover device, wherein the switchover device is designed to selectably associate the hot side with the first coolant outlet and the cold side with the second coolant outlet or associate the cold side with the first coolant outlet and the hot side with the second coolant outlet.

8. The cascade heat pump according to claim 1, wherein at least five, at least seven, or at least ten stages are provided.

9. A method for heating or cooling a coolant, carried out with a cascade heat pump comprising n stages where n≥2 according to claim 1, the method comprising:

providing a coolant flow to a coolant inlet of the heat pump of the first stage i=1, wherein, in each of the stages i, where i=1 . . . n−1, providing a first partial flow of the coolant to the coolant inlet of the heat pump of the subsequent stage i+1 through the first coolant outlet of the respective heat pump, wherein, in at least one of the subsequent stages i+1, where i=1 . . . n−1, a second partial flow of the coolant is fed to the coolant inlet of the heat pump of a preceding stage 1 . . . i through the second coolant outlet of the respective heat pump.

10. The method according to claim 9, wherein, in each of the subsequent stages i+1, where i=2 . . . n−1, the second partial flow of the coolant is fed to the coolant inlet of the heat pump of a preceding stage 1 . . . i through the second coolant outlet of the respective heat pump.

11. The method according to claim 10, wherein, in each of the subsequent stages i+1, where i=2 . . . n−1, the second partial flow of the coolant preferably is fed to the coolant inlet of the heat pump of the preceding stage i through the second coolant outlet of the respective heat pump.

* * * * *